US005651476A

United States Patent [19]

Percy et al.

[11] Patent Number: 5,651,476

[45] Date of Patent: Jul. 29, 1997

[54] MODULAR VENDING MACHINE

[75] Inventors: Charles W. Percy; Alvin V. Russell, both of Aiken, S.C.

[73] Assignee: Dixie-Narco, Inc., Williston, S.C.

[21] Appl. No.: 472,430

[22] Filed: Jun. 7, 1995

[51] Int. Cl.[6] ..... B65H 1/00

[52] U.S. Cl. ..... 221/131; 221/133; 221/123; 221/289

[58] Field of Search ..... 221/131, 133, 221/123, 289

[56] References Cited

U.S. PATENT DOCUMENTS

| | | | |
|---|---|---|---|
| 3,128,013 | 4/1964 | Holstein et al. | 221/131 |
| 3,144,113 | 8/1964 | Peterson | 221/131 |
| 3,151,773 | 10/1964 | Pickering | 221/131 |
| 4,591,070 | 5/1986 | Wirstlin | 221/131 |
| 4,722,455 | 2/1988 | Groover | 221/131 |
| 5,176,287 | 1/1993 | Suris | 221/131 |
| 5,335,818 | 8/1994 | Maldanis et al. | 221/131 |
| 5,361,938 | 11/1994 | Ishine | 221/289 |

*Primary Examiner*—William E. Terrell
*Assistant Examiner*—Khoi H. Tran
*Attorney, Agent, or Firm*—Renner, Kenner, Greive, Bobak, Taylor & Weber

[57] ABSTRACT

A modular vending machine for dispensing a variety of different sized products with at least one array received within a cabinet, wherein the array is made up of a plurality of storage chambers with a dispensing mechanism disposed at the bottom of each chamber. The cabinet can receive any number of arrays which in turn can receive any number of storage chambers. The modular vending machine further includes a sensing device received within a receiving trough for confirming that a product has actually been dispensed. The dispensing mechanism includes a solenoid actuated plunger wherein the plunger controls the movement of a toggle member which is movable between a blocking position and a dispensing position so that only a single product is dispensed.

16 Claims, 5 Drawing Sheets

MODULAR VENDING MACHINE

TECHNICAL FIELD

The invention herein resides in the art of vending machines and, more particularly, to such machines which are intended for dispensing canned commodities such as soft drinks and the like upon the tendering of cash or its equivalent. Specifically, the invention relates to an easy loading, modularized, positive dispensing vender for such articles.

BACKGROUND ART

The use of vending machines for various consumables is well known. Probably the most common of such venders is the soft drink vending machine in which containers such as cans or bottles of soft drinks are dispensed upon receipt and validation of a tendered value. Vending machines are also known to dispense juice packs, candy bars, and the like. In the past, the containers for such soft drinks have typically been of a uniform size. However, such beverages presently are found in various sizes of containers and vending machines must necessarily be tailored to accomodate a wide range of container sizes and shapes. Previously, vending machines were quite inflexible to receiving, maintaining, and dispensing containers of various sizes. Often, shims or the like were required to modify the storage column and dispensing mechanism for that purpose. Additionally, wasted space often resulted from such modifications, since the storage columns would necessarily be designed to accept the largest container and then be reconfigured downwardly to accept smaller containers—the difference in size between the containers constituting wasted space. Additionally, in the prior art, modifications to vending machines to customize them for particular containers was a laborious and time consuming proposition.

In previously known dispensers, the actual dispensing mechanism has also been particularly troublesome. In the past, rotating motors positioned at the bottom of the storage columns has provided for the ultimate dispensing of a container of the selected beverage. Oftentimes, cam actuation has been involved and timing problems associated with the dispensing have been encountered. Additionally, rotary motors are expensive and given to maintenance and/or reliability problems.

In the past, it has also been generally assumed that when a dispense cycle is actuated for the vending machine, the selected product is actually dispensed—without any confirmation of that activity at all. Based upon that assumption, if a selected container does not actually reach the consumer, the consumer is dissatisfied and the owner of the vending machine is often troubled by a complaint.

There is a need in the art for a modularized vending machine, given to ease of customization for acceptance of soft drinks in various sizes of containers and having a reliable and inexpensive dispensing mechanism.

DISCLOSURE OF INVENTION

In light of the foregoing, it is an aspect for the invention to provide a vending machine having modular storage columns.

Another aspect of the invention is to provide a vending machine having modular storage columns which may be easily loaded from the top of the columns.

Yet a further aspect of the invention is the provision of a vending machine having modular storage columns which allow for staggered vertical stacking of the containers to maximize the number of containers to be received in a particular space.

Yet an additional aspect of the invention is the provision of a vending machine having modular storage columns which have means for retarding the drop rate of cans and containers thereinto.

Still a further aspect of the invention is the provision of a vending machine having modular storage columns which are received on tracks for easy access, and which may be easily removed, replaced, and interchanged.

Yet an additional aspect of the invention is the provision of a vending machine having modular storage columns which incorporates a solenoid actuated toggling dispenser at the bottom of each such column.

Yet an additional aspect of the invention is the provision of a vending machine wherein a sensor is provided in association with the dispensing mechanism to sense the actual dispensing of a product and the passing thereof to a point of accessibility by a customer.

Still another aspect of the invention is the provision of a vending machine which provides a shortened vend cycle following the depression of a product button.

Still a further aspect of the invention is the provision of a vending machine capable of dispensing a diversity of package shapes and sizes from the same machine.

The foregoing and other aspects of the invention which will become apparent as the detailed description proceeds are achieved by a modular vending machine, comprising: a cabinet; and at least one array of a plurality of storage columns, said storage columns being interchangeably received within said array and adapted for receiving various shaped products for sale by the vending machine.

Additional aspects of the invention which will become apparent herein are attained by a dispensing mechanism adapted for use with a product vending machine, comprising: a housing disposed at a bottom of a storage column received within the vending machine; a plunger received with said housing; a support surface receiving a lowermost product in said storage column, and means for reciprocating said plunger and causing said support surface to dispense a lowermost product while still retaining all product above said lowermost product.

Yet additional aspects of the invention are achieved by a vending machine for dispensing products, comprising: a cabinet; at least one array of a plurality of interchangeable storage columns for retaining therein products to be dispensed, said array being maintained within said cabinet; and dispensing means disposed at the bottom of said plurality of storage columns for selective dispensing of product therefrom.

DESCRIPTION OF DRAWING

For a complete understanding of the objects, techniques, and structure of the invention reference should be made to the following detailed description and accompanying drawings wherein.

BEST MODE FOR CARRYING OUT THE INVENTION

Figure 1:
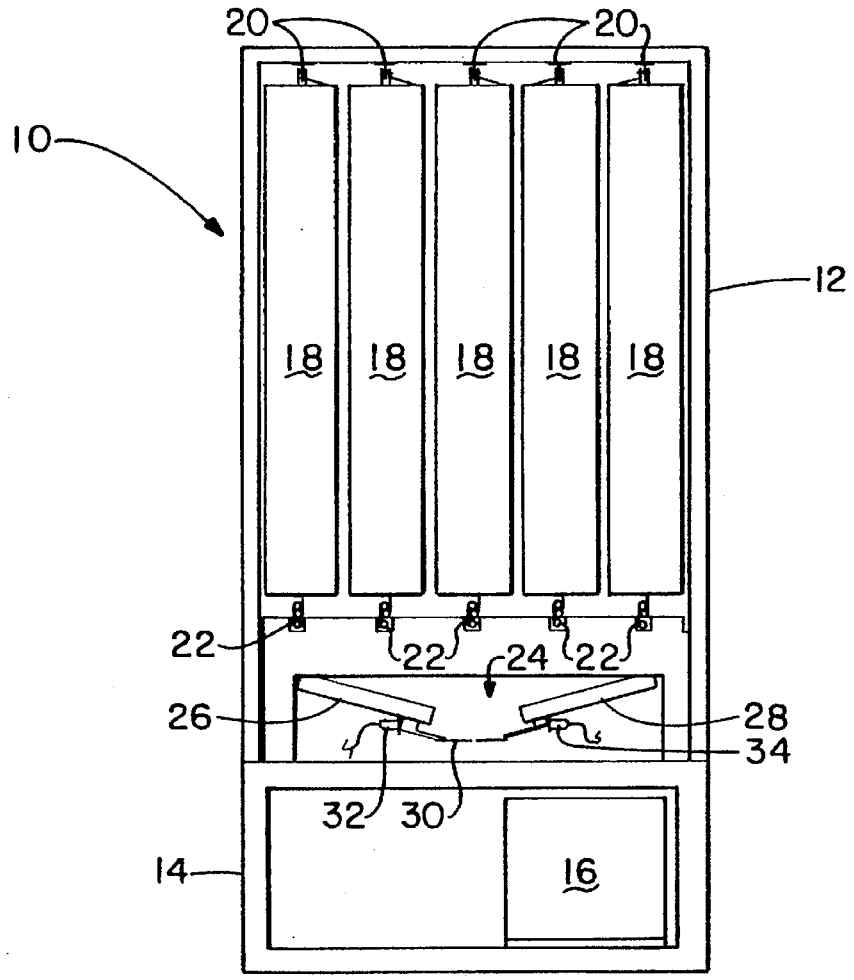
FIG. 1 is an illustrative front elevational view of a vending machine cabinet according to the invention, with the door removed.

Referring now to the drawings and more particularly FIG. 1, it can be seen that a vending machine made in accordance with the invention is designated generally by the numeral 10. The vender 10 is defined by a housing or cabinet 12, typically of metal construction. A base compartment 14 of the cabinet 12 is adapted for receiving an appropriate refrigeration system 16.

In an upper portion of the cabinet 12 there is provided a plurality of arrays of modular container stacking columns 18, there being five shown in the drawing. The arrays 18 are maintained and received between tracks 20, 22 respectively at the top and bottom of each such array. In implementation, the sliding tracks 20, 22 are of a somewhat standard nature such as typically known drawer guides, comprising a pair of slidingly engaged track members which may have bearings or the like interposed therebetween. As will be discussed in further detail below, one of the members of each of the tracks 20, 22 is connected to the associated array 18, while the other member is connected to a fixed portion of the cabinet 12. As further shown in FIG. 1, the upper tracks 20 and lower tracks 22 are typically positioned with respect to each other such as to provide for secure and balanced maintenance of the arrays 18.

A receiving trough 24 is maintained within the cabinet 12 beneath the assembly of arrays 18, as shown. The receiving trough 24 is defined by a pair of downwardly angled converging plates 26, 28 which are intended to direct cans or other products released from any of the stacking columns of the arrays 18 to a receiving plate 30 where the container can be retrieved by a customer.

Also included as a portion of the instant invention is a means for sensing the actual dispensing of a container of beverage. For this purpose, an optical transmitter 32 and receiver 34 are positioned on opposite sides of the trough 24 at the receiving plate 30. When the light beam extending between the two is interrupted by a passing container, the resultant signal is taken as an indication that a container has actually been dispensed. It will, of course, be appreciated that the element 34 might comprise an optical transducer consisting of both a transmitter and receiver, with the element 32 simply being a reflective surface for that purpose. In any event, the concept of the invention provides a means at the dispensing trough for actually monitoring the dispensing of a container. In the event that the dispensing mechanism is actuated, but no container is sensed, the vending machine 10 can determine that there are no more containers of the requested beverage available for dispensing, or that the associated storage column is jammed, or that some other condition exists preventing dispensing of the associated beverage. Appropriate remedial action can then be taken. While an optical sensor has been described, it will be appreciated that a variety of other sensors may be employed.

Figure 2:
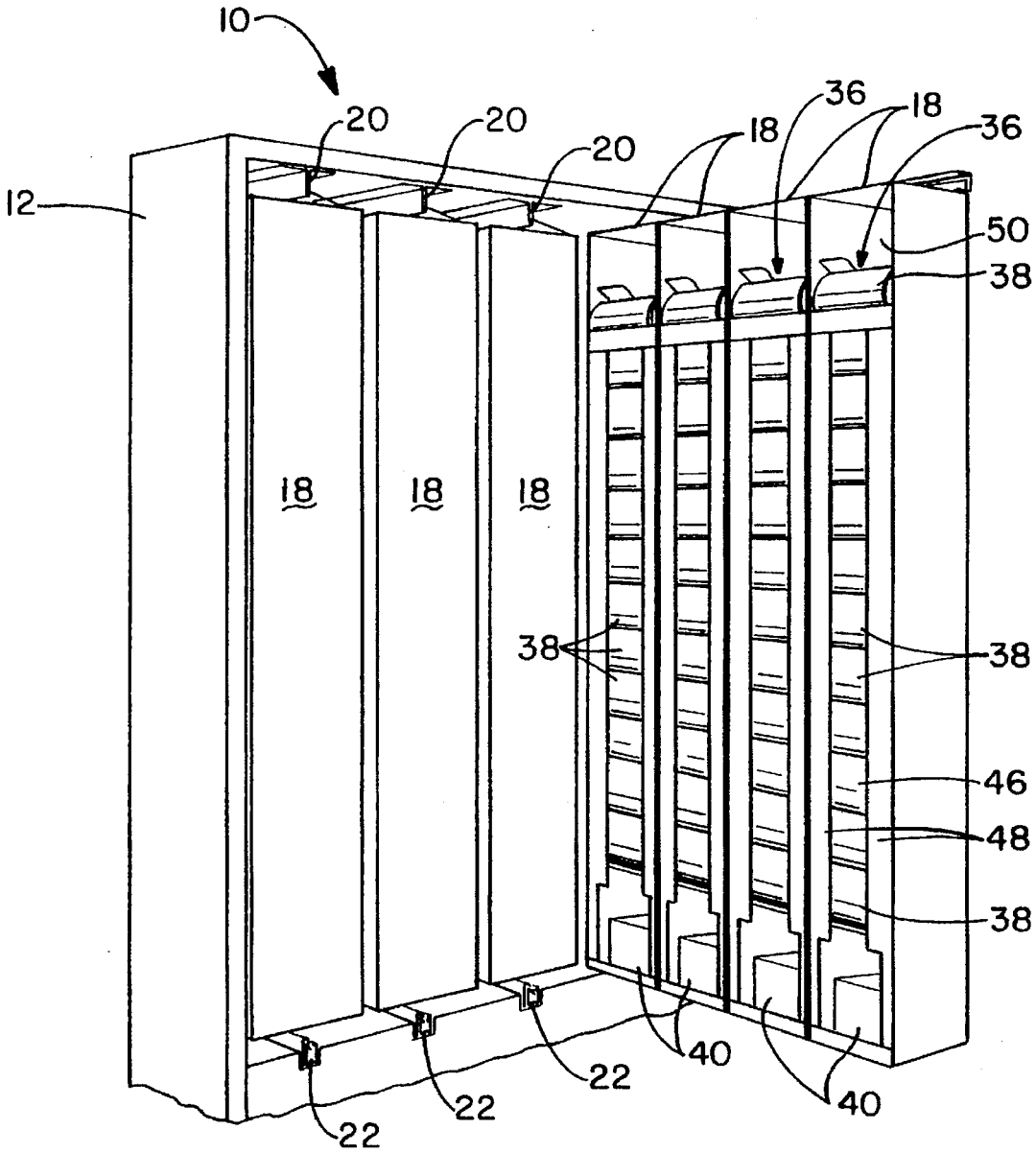
FIG. 2 is an isometric view of a vending machine according to the invention, showing an array of storage columns being retracted from the cabinet thereof.

With reference now to FIG. 2, it can be appreciated that the arrays 18 of modular container stacking columns can be readily withdrawn from the cabinet 12 upon the tracks 20, 22. Such withdrawal allows for the servicing of the vending machine 10 by the replenishment of containers in the various modular stacking columns 36. Additionally, it also allows for the modification of the stacking column as desired. In other words, while four modular container stacking columns 36 are shown in the array 18 withdrawn from the cabinet 12 in FIG. 2, the array 18 might only include three or two modular storage columns 36, each receiving much larger containers than those presently shown. It will also be appreciated that various shaped containers could be stored in the columns 36.

As further shown in FIG. 2, each of the storage columns 36 maintains a plurality of containers 38 which could be cans, bottles or other products. As will become apparent later herein, conservation of space is attained by vertically stacking the containers 38 in a staggered arrangement, with the central axis of the containers 38 being horizontally maintained.

At the bottom of each of the storage columns 36 is a dispensing mechanism 40 which will be discussed later herein. Suffice it to say at this time, that each of the dispensing mechanisms 40 is a solenoid actuated, positive acting, toggling device which assures the positive dispensing of a single container 38 upon each actuation.

Figure 5:
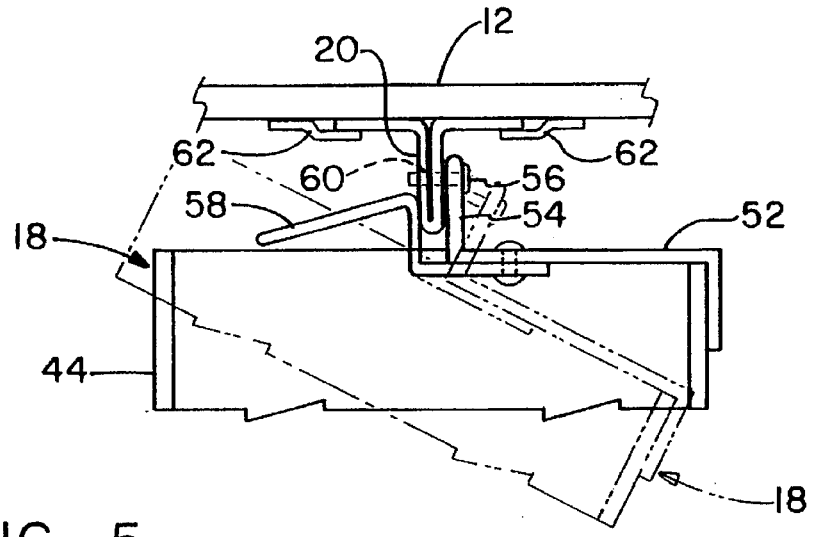
FIG. 5 is a partial cross-sectional view of the storage column carried by the cabinet.
Figure 3:
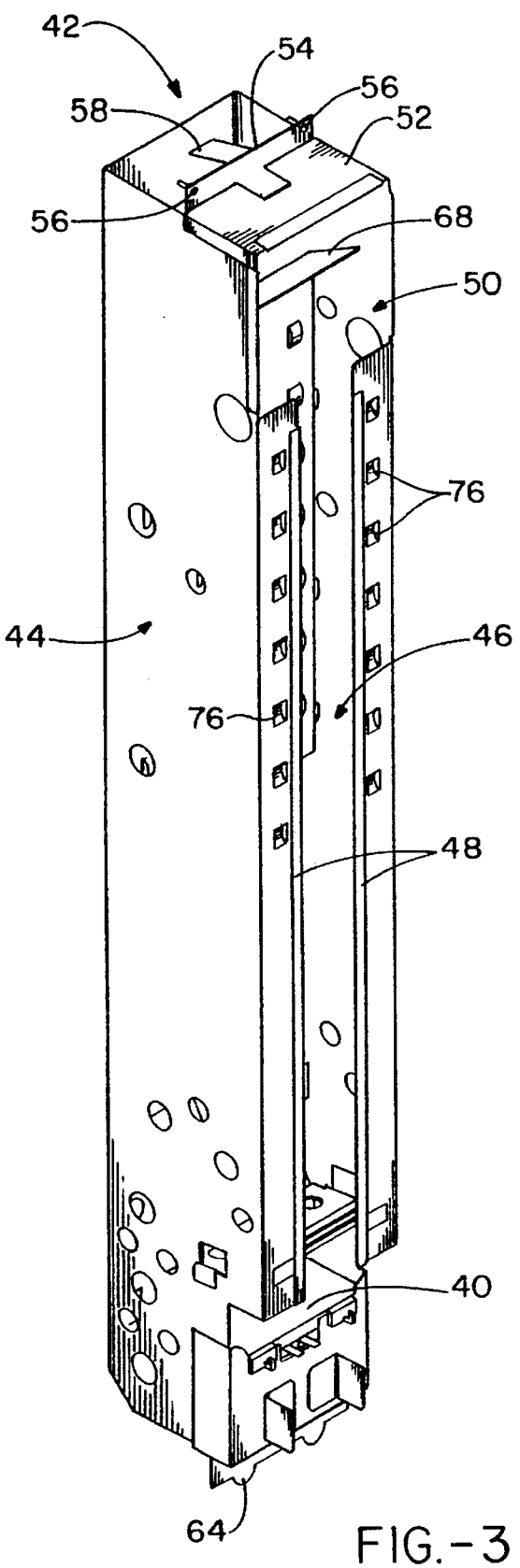
FIG. 3 is an isometric view of a storage column according to one embodiment of the invention.
Figure 4:
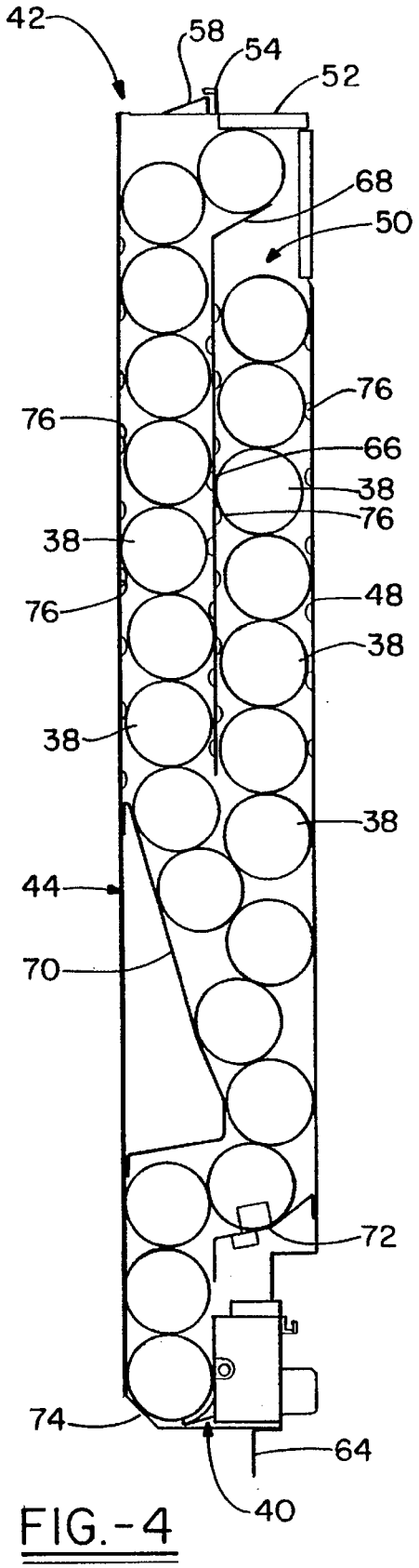
FIG. 4 is a side elevational view of the storage column of FIG. 3.

Referring now to FIGS. 3, 4 and 5, an appreciation of one storage column 42 made in accordance with the invention can be seen. Here, the storage column 42 comprises a vertically elongated rectangular housing 44 which is closed on three sides thereof and provided with a center opening 46 down the from thereof as defined by a pair of opposed side flanges 48. An opening 50 at the top of the front of the housing 44 is provided for placement of containers 38 therein. A top plate or cap 52 is provided at the top of the housing 44 to close the same. A flange 54 extends upwardly from a central portion of the cap 52 with a pair of locator pins 56 carried by the flange 54 at each end thereof. Centrally disposed along and spaced from the flange 54 is a latch spring 58 which is connected to the cap 52. An upper track 20, secured to the cabinet 18 by brackets 62 and slidable therein, is adapted to engage the storage column 42 by receipt between the flange 54 and latch spring 58, is presented below.

The storage column 42 may be placed into an array 18 by placing the flange 64, extending downwardly from the bottom of the housing 44, into a receiving slot in a lower sliding track 22. With the upper track 20 having a plurality of apertures 60 extending therealong, the lateral position of the storage column 42 may be established by selected engagement of the locator pins 56 with specific apertures 60, with the track 20 being secured between the latch spring 58 and the flange 54. With the storage column 42 slightly tilted away from the vertical as shown in FIG. 5, it may be positioned along the lower track 22 at a desired position, at which time the storage column 42 is pivoted to vertical position as shown in FIG. 5, with the latch spring 58 being deflected by the track 20 until the track 20 engages the flange 54 and the pins 56 are appropriately received in the apertures 60. The storage column 42 is thus fixedly secured between the upper and lower tracks 20, 22. Although FIG. 5 shows the latch spring 58 as a separate element, it will be appreciated that the cap 52 could be formed with the latch spring 58 as an integral element thereof.

As best shown in FIG. 4, a center partition 66 is maintained within the housing 44 and serves to divide the chamber of the storage column 42 into two distinct halves at the upper portion thereof. An in-feed ramp 68 extends from the centered partition in an upward angular posture toward the opening 50. Accordingly, containers inserted through the opening 50 upon the ramp 68 roll down one side of the cavity, while cans inserted through the opening 50 beneath the ramp 68 roll down the other. A deflecting plate 70 extends from an inner surface of the rear wall of the housing 44 inwardly toward the front wall thereof, to neck down the cavity from one accommodating two stacks of containers 38, to one containing a single stack. It will be appreciated that the deflecting plate 70 begins at an area near the bottom of the center partition 66 and ramps inwardly toward the front flanges 48 to converge the two channels defined by the center partition 66 into one.

A return plate 72 extends inwardly from the rear flanges 48 and directs the single column of containers toward the front of the chamber defined by the housing 44 and then downwardly to the dispensing mechanism 40. An opening 74 is provided at the lower rear corner of the housing 44 rearwardly of the dispensing mechanism 40 which has a member partially blocking the opening 74 until actuated to allow the dispensing of a single container 38. The operation of the mechanism 40 in that regard can be discussed later herein.

Also provided as a portion of the instant invention are dimples or staked protrusions 76 which extend inwardly into the cavity of the housing 44 from the rear plate and front flanges thereof. Additionally, dimples or protrusions 76 also extend from opposite sides of the center partition 66, as shown. It will also be noted that the dimples or protrusions 76 formed as a portion of the housing 44 and those formed as a portion of the partition 66 are off set with respect to each other. These dimples or protrusions 76 are of sufficient amplitude and frequency to retard the movement of a container downwardly along the associated channel. In other words, the container will effectively "walk" back and forth within the channel between the dimples as it progresses downwardly in the cavity of the housing 44. Accordingly, the dimples or protrusions 76 retard or slow the downward movement of the containers 38 to prevent denting, rupturing, or damage thereto. Additionally, the dimples or protrusions 76 are so spaced as to prevent the insertion of containers 38 into the stack in other than a horizontally aligned posture. In other words, the containers can not be inserted with their major axis in other than a horizontal position.

Figure 6:
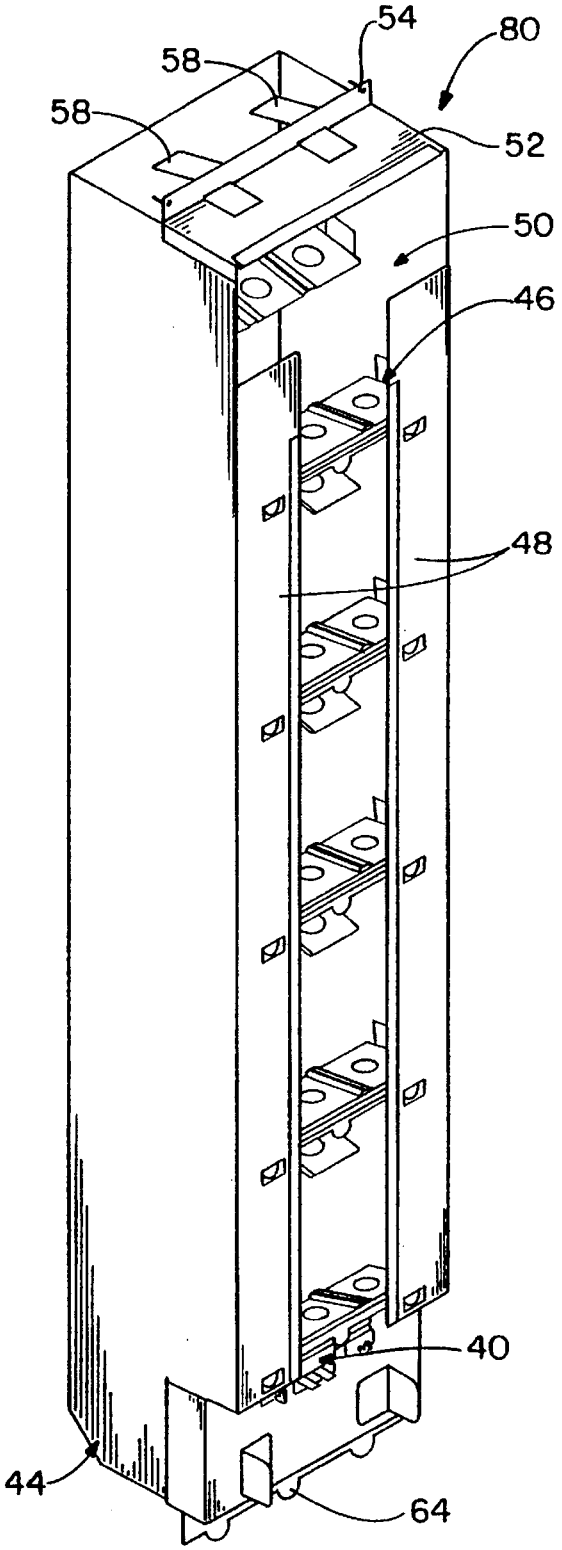
FIG. 6 is an isometric view of a storage column according to a second embodiment of the invention.
Figure 7:
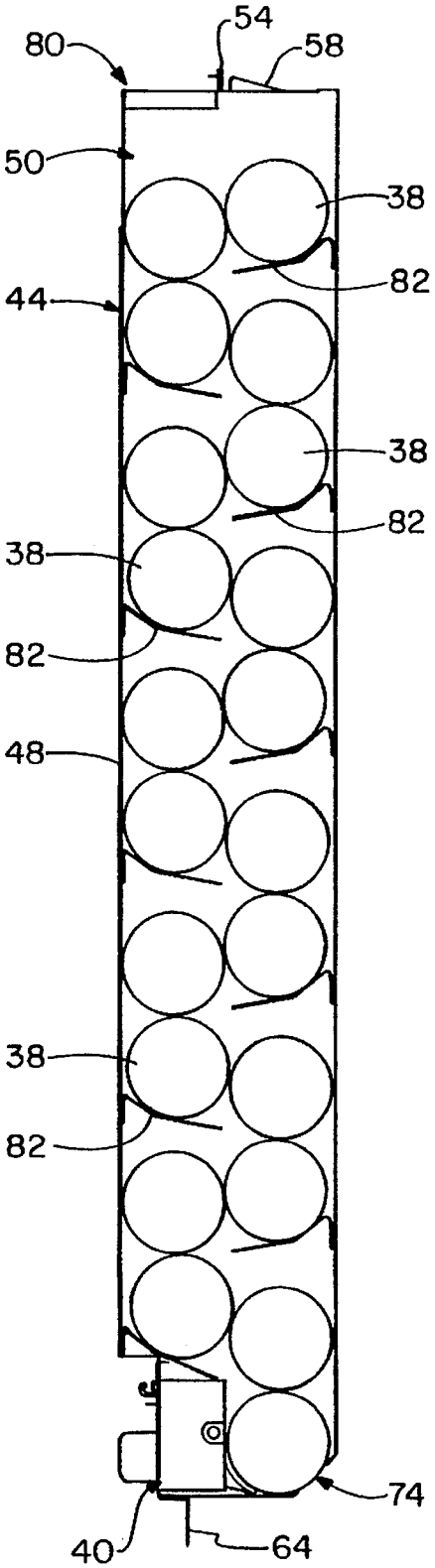
FIG. 7 is a side elevational view of the storage column of FIG. 6.

Referring now to FIGS. 6 and 7, an alternative storage column 80 made in accordance with a second embodiment of the invention can be seen as generally designated by the numeral 80. It will be appreciated that much of the structure of the assembly 80 corresponds to that of the storage column 42 and, in that regard, similar reference numerals have been employed. Of particular interest, however, is the provision of downwardly angled guide plates 82 extending between the side walls of the housing 44 in the embodiment 80. The guide plates 82 alternate between the rear wall and the front flanges of the storage column 80 in downward step-wise fashion from the access opening 50. Accordingly, as containers are placed into the storage column 80, they roll downwardly reciprocating from front to rear in the cavity defined by the housing 44 to establish a staggered vertical column of containers 38. Again, the dispensing mechanism 40 blocks the outlet opening 74 to allow for selected single dispensing of containers in a manner which will become apparent directly below.

Figure 8:
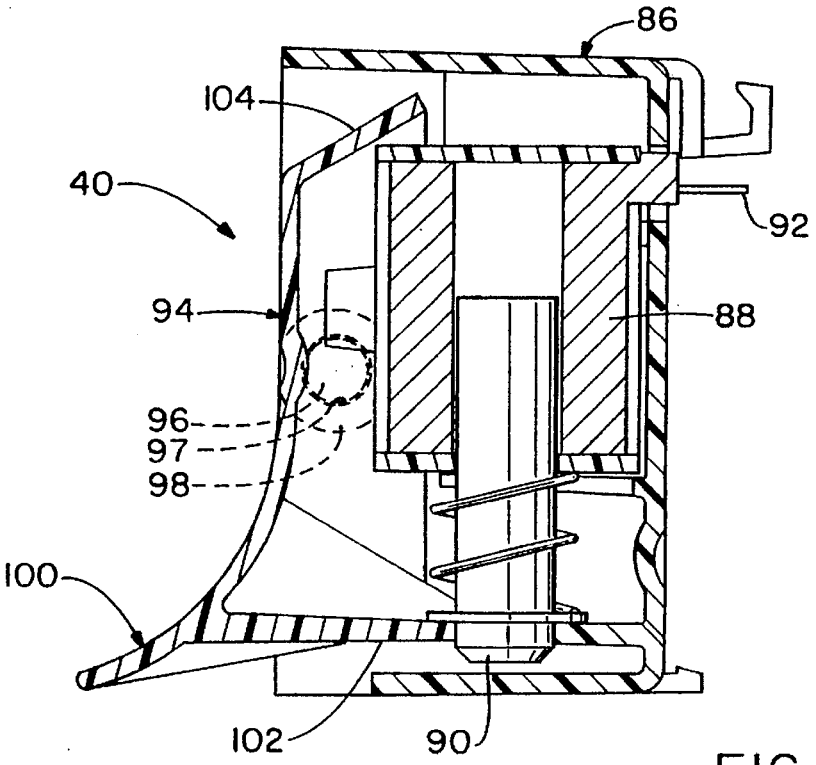
FIG. 8 is a side elevational view in partial cross-section of the solenoid-actuated toggling dispensing mechanism of the invention in a support mode.
Figure 9:
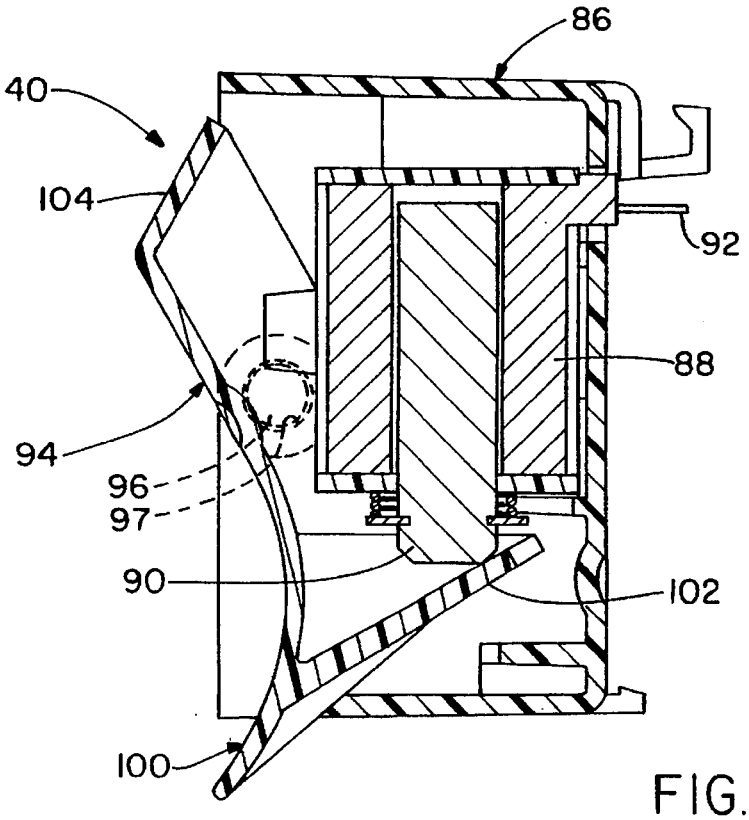
FIG. 9 is a side elevational view in partial cross-section of the mechanism of FIG. 8 in a dispense mode.

Referring now to FIGS. 8 and 9 an understanding of the structure and operational technique of the dispensing mechanism 40 can be attained. As illustrated, the dispensing mechanism 40 includes a housing 86 receiving a solenoid 88 having an associated spring biased solenoid plunger 90 reciprocatingly received thereby. A pair of electrical contacts 92 extend from the solenoid 88 in standard fashion. A toggle member 94 has outwardly extending pins 96 pivotally received within the housing 86 through apertures 97 in parallel side flanges 98. A bottom support surface 100 extends outwardly at a bottom end of the toggle member 94 and is in a generally curved posture at the opening 74 at the bottom corner of a storage column 42, 80 of FIGS. 3–7. The bottom support surface 100 is adapted to receive the lowermost container in the column of containers received by the associated storage column and to support such stack of containers thereby.

Extending in a direction opposite that of the bottom surface plate 100 is an actuation tab 102. It will be appreciated that, with the containers engaging the bottom support surface 100, the toggle member 94 will be urged about the pivot axis pin 96 such that the actuation tab 102 is in engagement with the solenoid plunger 90. In this position, the column of containers 38 is in a quiescent state. When it is desired to dispense a container 38, the solenoid 88 is actuated and the plunger 90 withdrawn. Accordingly, engagement between the actuation tab 102 and plunger 90 is lost such that the toggle member 94 pivots about the axis pin 96 in such a manner as to remove the bottom support surface 100 from its blocking position in the opening 74, thus allowing the lowermost container 38 to pass through the opening 74 and be dispensed. The rotational movement of the toggle member 94, as best shown in FIG. 9, causes a blocking lip 104 at an end of the toggle member 94 opposite that of the bottom support surface 100, to enter into the column of containers 38 and to receivingly engage that container 38 next to the lowermost container. Accordingly, while the lowermost container 38 is allowed to be dispensed through the opening 74 by the rocking action of the toggle member 94, that same rocking action secures and retains the remainder of the column of containers 38 substantially in their original position. Following the dispensing, the solenoid 92 is deactivated such that the spring biased plunger 90 is urged downwardly against the actuation tab 102 to prevent subsequent vend cycles while allowing the weight of the remaining containers to rock the toggle member 94 to its normal position as shown in FIG. 8. As a consequence, all of the containers 38 index downwardly the distance of one container, such that the container previously retained by the blocking lip 104 is now received and supported by the bottom support surface 100, becoming the lowermost container ready for dispensing.

It should be readily appreciated that the height of the toggle member 94 is substantially equivalent to the diameter of a container 38 to be dispensed, such that the toggling action of the member 94 allows the lowermost container to be dispensed and the next container to be engaged by the blocking lip 104.

It will be readily appreciated by those skilled in the art that the storage columns 42, 80 according to the invention may be of various dimensions, adapted for receiving various different sizes of containers. Accordingly, the arrays 18 of the modular container storage columns 36 may be comprised of various interchangeable sizes of columns 42, 80 such that products in various sizes of containers can be accommodated, space utilization optimized, and dispensing effectiveness maximized. Some arrays 18 may have four storage columns, while others may have only two or three, depending upon the configuration of the container being accommodated. In any event, the interchangeability of the storage columns 42, 80 allows for the achievement of a modularized vending machine which can be tailored in the factory or field to accomodate different containers, while achieving optimum dispensing effectiveness.

Thus it can be seen that the objects of the invention have been attained by the structure presented above. While in accordance with the patent statutes only the best mode and preferred embodiment of the invention has been presented and described in detail, the invention is not limited thereto or thereby. Accordingly, for an appreciation of the true scope and breadth of the invention, referenced should be made to the following claims.

What is claimed is:

1. A modular vending machine, comprising:

a cabinet;

at least one array of a plurality of storage columns, said storage columns being interchangeably received within said array and adapted for receiving and dispensing various shaped products for sale by the vending machine; and a receiving trough maintained within said cabinet and disposed beneath said arrays for directing product from said storage columns to a position retrievable by a consumer, said receiving trough having means for sensing the actual dispensing of a product.

2. The machine according to claim 1, further comprising means for receiving and maintaining a plurality of said arrays and wherein said arrays are comprised of varying numbers of said storage columns.

3. The machine according to claim 2, wherein said means for sensing comprises:

an optical transmitter for transmitting a light beam; and an optical receiver positioned opposite said optical transmitter for receiving the light beam and detecting when the light beam is interrupted to indicate that the product has actually been dispensed.

4. The machine according to claim 2, further comprising a dispensing mechanism disposed at a bottom of each said storage column, said dispensing mechanism having a support surface engaging a product when disposed in a blocking position, wherein a toggle member is actuated to move said support surface from said blocking position to a dispensing position to allow the dispensing of one product while blocking remaining products within said storage chamber.

5. A dispensing mechanism in a product vending machine, comprising:

a housing disposed at a bottom of a storage column received within the vending machine;

a plunger received within said housing;

a support surface receiving a lowermost product in said storage column;

means for reciprocating said plunger and causing said support surface to dispense a lowermost product while still retaining all product above said lowermost product, said means for reciprocating having a solenoid for reciprocatingly moving said plunger, and a toggle member carrying said support surface and an actuation tab, wherein said plunger controls dispensing movement of said toggle member by engaging and disengaging said actuation tab.

6. The dispensing mechanism according to claim 5, wherein said housing has a pair of side flanges with apertures, and wherein said toggle member has outwardly extending pins rotatably received within said apertures such that when said plunger is retracted, said toggle member pivots to allow the lowermost product on the support surface to be dispensed from said storage column.

7. The dispensing mechanism according to claim 6, wherein said toggle member has a blocking lip at an end opposite said support surface, and wherein said blocking lip receivingly engages a product next to the lowermost product while said support surface is in a dispensing position.

8. The dispensing mechanism according to claim 7, wherein the product next to the lowermost product becomes the lowermost product when said support surface is returned from the dispensing position to the blocking position.

9. A vending machine for dispensing products, comprising:

a cabinet;

at least one array of a plurality of interchangeable storage columns for retaining therein products to be dispensed, said array being maintained within said cabinet; and dispensing means disposed at the bottom of said plurality of storage columns for selective dispensing of product therefrom, wherein at least one column comprises a vertically elongated housing having at least one path therein between an entrance and exit, the products traveling said path, and said path having deflection means therein for reciprocating movement of the products from one side of said path to another as the products travel said path.

10. The vending machine according to claim 9, wherein said cabinet has a receiving trough maintained within said cabinet beneath said dispensing means.

11. The vending machine according to claim 9, further comprising receiving means for receiving a plurality of said arrays, each said array having at least one storage column.

12. The vending machine according to claim 11, wherein each said receiving means comprises a track disposed at each of opposite ends of each said storage column, each said array having a uniquely associated pair of tracks, said storage columns being removably received between said tracks.

13. The vending machine according to claim 11, wherein said plurality of storage columns are interchangeably sized to accomodate various sized and shaped products within the vending machine.

14. The vending machine according to claim 13, wherein said dispensing mechanism is disposed at a bottom of each of said plurality of storage columns, said dispensing mechanism having a toggle member having a blocking lip, a support surface, and an actuation tab which contacts a plunger.

15. The vending machine according to claim 14, wherein said toggle member pivots when said plunger is withdrawn from contact with said actuation tab to move said toggle member from a blocking position to a dispensing position, and wherein said support surface is withdrawn from supporting a lowermost product which is received by said receiving trough while simultaneously said blocking lip engages a product next to the lowermost container until said plunger is again placed in contact with said actuation tab to return said toggle member to a blocking position.

16. The vending machine according to claim 9, wherein said housing has a center partition establishing two paths for said products, each of said paths communicating with said entrance and said exit.

* * * * *